US006233086B1

(12) United States Patent
Hardiman

(10) Patent No.: US 6,233,086 B1
(45) Date of Patent: May 15, 2001

(54) LIGHT PATTERN MODULATOR AND AN APPARATUS FOR AND METHOD OF GENERATING LIGHT PATTERNS IN RESPONSE TO AN ELECTRICAL OSCILLATING SIGNAL

(76) Inventor: Dan Hardiman, 26 Numa Ct. Brentford, Dock, Brentford, Middlesex, TW8 8QG (GB)

( * ) Notice: Subject to any disclaimer, the term of this patent is extended or adjusted under 35 U.S.C. 154(b) by 0 days.

(21) Appl. No.: 09/082,173

(22) Filed: May 20, 1998

(30) Foreign Application Priority Data

May 23, 1997 (GB) ..... 9710801

(51) Int. Cl.[7] ..... G02B 26/00

(52) U.S. Cl. ..... 359/290; 359/223; 359/225; 84/464 R

(58) Field of Search ..... 84/464 R; 359/223, 359/224, 225, 226; 355/53

(56) References Cited

U.S. PATENT DOCUMENTS

| | | | | |
|---|---|---|---|---|
| Re. 36,455 | * | 12/1999 | Loebner | 345/156 |
| 4,010,361 | * | 3/1977 | Latterman et al. | 84/464 R |
| 4,158,982 | | 6/1979 | Chusid | 84/464 |
| 4,205,585 | * | 6/1980 | Hornick | 84/464 R |
| 4,227,785 | * | 10/1980 | Herbert | 353/50 |
| 4,327,975 | * | 5/1982 | Harris | 353/50 |
| 4,346,640 | * | 8/1982 | Zeno et al. | 84/464 R |
| 4,988,976 | * | 1/1991 | Lu | 340/461 |
| 5,137,363 | * | 8/1992 | Kosugi et al. | 356/401 |
| 5,664,859 | * | 9/1997 | Salerno et al. | 353/119 |
| 5,668,611 | * | 9/1997 | Ernstoff et al. | 348/771 |
| B1 4,779,176 | | 8/1991 | Bornhorst | 362/223 |

FOREIGN PATENT DOCUMENTS

| | | |
|---|---|---|
| 952059 | 3/1960 | (GB) . |
| 2 303 559 | 6/1995 | (GB) . |
| 2 292 896 | 3/1996 | (GB) . |

OTHER PUBLICATIONS

"Extending Bass", *Electronics World + Wireless World,* Feb. 1994, pp. 100–205.

* cited by examiner

*Primary Examiner*—Georgia Epps
*Assistant Examiner*—Timothy Thompson
(74) *Attorney, Agent, or Firm*—Joseph R. Kelly; Westman, Champlin & Kelly, P.A.

(57) ABSTRACT

A light pattern modulator includes modulating means for modulating light instant thereon. The modulating means are mounted on at least two actuators which effect linear displacement in response to an electrical oscillating signal from input means. The mounting of the modulating means on the actuators enables movement of the modulating means effected by the actuators not to be physically constrained to movement about a fixed point or axis.

44 Claims, 5 Drawing Sheets

(3 of 5 Drawing Sheet(s) Filed in Color)

LIGHT PATTERN MODULATOR AND AN APPARATUS FOR AND METHOD OF GENERATING LIGHT PATTERNS IN RESPONSE TO AN ELECTRICAL OSCILLATING SIGNAL

The present invention relates generally to lighting technology for use in the entertainment industry e.g. on stage, in concerts, theatres, clubs, discos etc. In particular, the present invention relates to special effects involving the projection of an image onto smoke, a stage, a screen or a backdrop. Specifically, the present invention relates to a light pattern modulator and to an apparatus for and a method of generating light patterns in response to an electrical oscillating signal.

There are many aspects to providing creative and effective lighting displays, particularly in conjunction with the generation of sound such as music. The lighting aspect may include spotlights, floodlights, colours and moving light images and strobes. A significant aspect of such lighting is the projection of images onto a stage, a backdrop, a screen, the performers themselves or through smoke (creating a shaped beam). As such, any lamp fixture which produces an image can be considered as a projector and the majority of lamp fixtures have the capability of projecting an image in this way. Their use is no longer limited to theatrical work and pop concerts but has been expanded to exhibitions, corporate work, advertising (e.g. projections of advertising logos onto buildings) and nightclubs. Modern technical developments have led to increasingly versatile lighting units incorporating movement, colour-changing, image-producing (be it simple beam or complex "chrome-etched" images), image overlaying, image movement (facilitated by rotating discs called "gobos"), image effects (by moving prisms) strobing, remote focussing and a variety of remotely accessed lenses.

It is an object of the present invention to enhance the effects of existing light projection systems.

According to a first aspect of the present invention there is provided a light pattern modulator comprising:

input means for receiving an electrical oscillating signal;

at least two actuators for effecting linear displacement in response to the electrical oscillating signal;

modulating means for modulating light incident thereon, the modulating means being mounted on said at least two actuators for enabling movement of the modulating means effected by said at least two actuators not to be physically constrained to movement about a fixed point or axis.

The light pattern modulator of this first aspect of the present invention can be added to existing light projection systems to add three-dimensionality and texture to the projected images. The provision of at least two actuators for effecting linear displacement of different regions of the modulating means mounted on the actuators allows the modulating means to be deflected in a variety of different ways. In particular, movement of the modulating means effective by the actuators is not physically limited to movement about a fixed point or axis. Furthermore, the provision of two or more actuators means that each actuator can respond to a different electrical oscillating signal (which may be the same oscillating signal but having different phases).

Advantageously, the modulating means comprises a single modulating means mounted on at least two actuators for effecting linear displacement in response to the oscillating signal. Such an arrangement may create special effects without significantly affecting the focussing of the projected image particularly when the modulating means comprises a planar mirror.

It is envisaged that a variety of modulating means may be used including simple reflectors, the reflector dish of a lamp, a lens or a prism.

Advantageously, the light pattern modulator comprises at least three actuators. The provision of three actuators significantly increases both the range and rate of movement of the modulating means.

Conveniently, the actuators may comprise inductors positioned within a magnetic field for responding to the electrical oscillating signal, similar to the arrangements used with conventional loudspeakers. Other actuators may also be used including displacement transducers, solenoids, pneumatic pistons, piezoelectric devices, oscillations set up in stepper motors or geared motor oscillation systems.

The input means may comprise phase delay means for generating a phase delayed oscillating signal, the phase delay means being coupled to at least one of the actuators and, in particular, the phase delay means may be effective for coupling an oscillating signal of a different phase to each actuator. Such an arrangement causes each point in the projected image to describe a three-dimensional ring with a stunning visual impact.

Amplifier means for amplifying the oscillating signal may be coupled between the phase delay means and the actuators depending on the amplitude of the oscillating signal and the desired range of movement of the modulating means.

The light pattern modulator of the first aspect of the present invention may further comprise a frequency generator for generating an oscillating signal. Most advantageously, the light pattern modulator of the first aspect of the present invention may further comprise audio means for generating an electrical audio signal to create a movement of the modulating means and hence of the projected image which is synchronised with sound derived from the electrical audio signal.

A second aspect of the present invention provides apparatus for generating light patterns in response to an electrical oscillating signal, the apparatus comprising:

input means for receiving an electrical oscillating signal;

at least one actuator for effecting linear displacement in response to the oscillating signal;

modulating means for modulating light incident thereon, the modulating means being mounted on said at least one actuator;

and light projection means for projecting an image onto the modulating means.

The second aspect of the present invention provides an apparatus in which the projected image can be moved in response to an electrical oscillating signal to create dynamic effects.

Conveniently, the light projection means comprises a non-laser light source such as a filament lamp or an arc lamp. Fluorescent lighting may also be used. The present invention may be used with laser light sources used to generate images but is not dependent on the use of laser light sources with the expense and safety requirements that this involves.

The light projection means may comprise means for projecting an image which varies with time, in particular a means for pulsing the image. As the modulating means is caused to move in response to an electrical oscillating signal, the combination of the variation in movement provided by the modulating means and the variation of the image can create a special effect. The means for pulsing the image may comprise an arc lamp caused to strike at the frequency of the power supply e.g. 50 Hz. At such a rate, the human eye perceives the arc lamp to be constantly lit but the use of modulating means moving in response to an electrical oscillating signal of about the same frequency causes an effect similar to the effect of strobe lighting on a moving object.

The apparatus of the second aspect of the present invention may be further modified as set out with regard to the light pattern modulator of the first aspect of the present invention set out above.

A third aspect of the present invention provides a method of generating light patterns in response to an electrical oscillating signal, the method comprising the steps of:

projecting a light image;

and modulating the light image to produce a modulated light image, the modulating step comprising the steps of:

receiving an electrical oscillating signal;

moving a modulating means onto which the light image is projected in response to the oscillating signal.

The third aspect of the present invention provides a method in which the projected image can be moved in response to an electrical oscillating signal to create dynamic effects.

Conveniently, a non-laser light source, such as a filament lamp or an arc lamp, is used to project the image. The present invention may involve the use of laser light sources to generate images for projection but is not dependent on the use of laser light sources with the expense and safety requirements that this involves.

The step of moving the modulating means may comprise applying an oscillating force to at least two regions of the modulating means, the oscillating force having a frequency and an amplitude determined by the electrical oscillating signal to move the modulating means in response to the oscillating signal. Advantageously, the step of applying an oscillating force may comprise the step of applying different oscillating forces to at least two regions of a single modulating means allowing the modulating means to be deflected in a variety of different ways. In particular, the step of applying different oscillating forces may comprise the step of applying oscillating forces having the same frequency in amplitude but different phases resulting in pivoting of the modulating means about an imaginary point and so not affecting the focussing of the projected image.

The step of receiving the oscillating signal may comprise the step of receiving a signal generated by a frequency generator or an electrical audio signal. Advantageously, the electrical audio signal may also be input to a sound system for generating sound in response to the electrical audio signal to create a movement of the modulating means and hence of the projected image which is synchronised with sound derived from the electrical audio signal.

The file of this patent contains at least one drawing executed in color. Copies of this patent with color drawings are provided to the Patent and Trademark Office with payment of the necessary fee.

Embodiments of the present invention will now be described, by way of example only, and with reference to the accompanying drawings in which.

Figure 1:
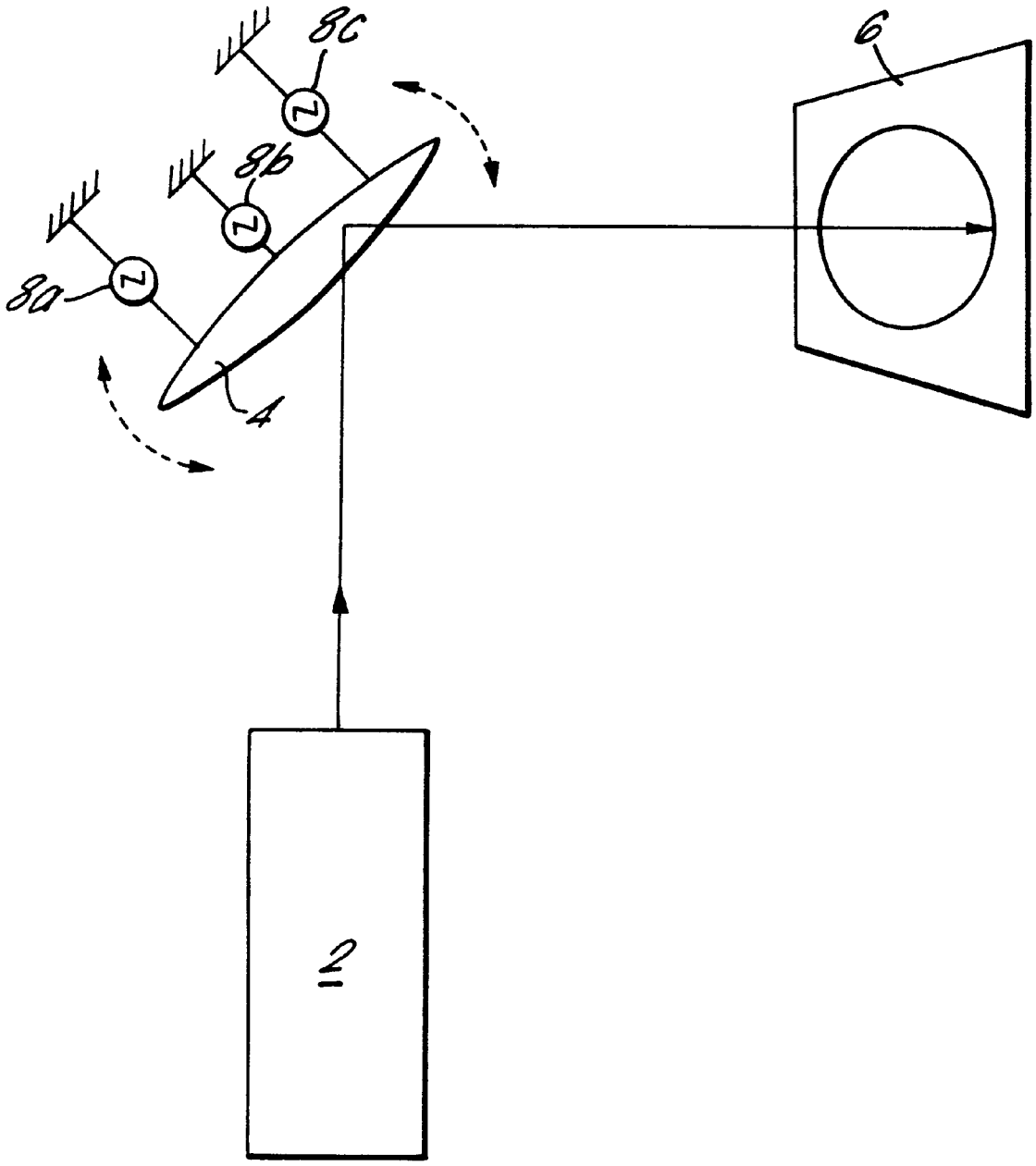
FIG. 1 shows schematically an embodiment of an apparatus provided in accordance with the present invention.

FIG. 1 shows a light projector 2 for projecting an image. The image from the light projector 2 is projected onto a movable circular mirror 4 which modulates the image and the modulated image is projected onto a screen 6. Typical dimensions for a mirror 4 could be a diameter of 150 mm and a mass of about 35 g. The circular mirror 4 is mounted on three actuators 8*a*, 8*b*, 8*c* which are spaced equidistantly around the circumference of the circular mirror 4. The actuators 8*a*, 8*b*, 8*c* each comprise an inductor located within a magnetic field with a cone of plastic material attached to the inductor in a construction similar to the construction of a loudspeaker. The cone is attached to the mirror 4 using an interface of foam material which is effective to increase the flexibility of the interface and also to damp higher frequencies of movement. When an electrical oscillating signal is input to the inductor, the inductor is caused to vibrate resulting in a linear oscillating force being applied to the mirror 4.

Advantageously, the mirror 4 is mounted only on the actuators 8*a*, 8*b*, 8*c* and so there is no other physical constraint to the movement of the mirror. The deflection of the mirror 4 from its rest position (when no oscillating signal is input to the actuators 8*a*, 8*b*, 8*c*) is therefore determined by the frequency and amplitude of the oscillating signals input to the actuators 8*a*, 8*b*, 8*c* and the inertia of the system. The oscillating signal is preferably chosen to have or to include a frequency which is at or near the resonant frequency of the system to generate vibrations of maximum amplitude.

Figure 2:
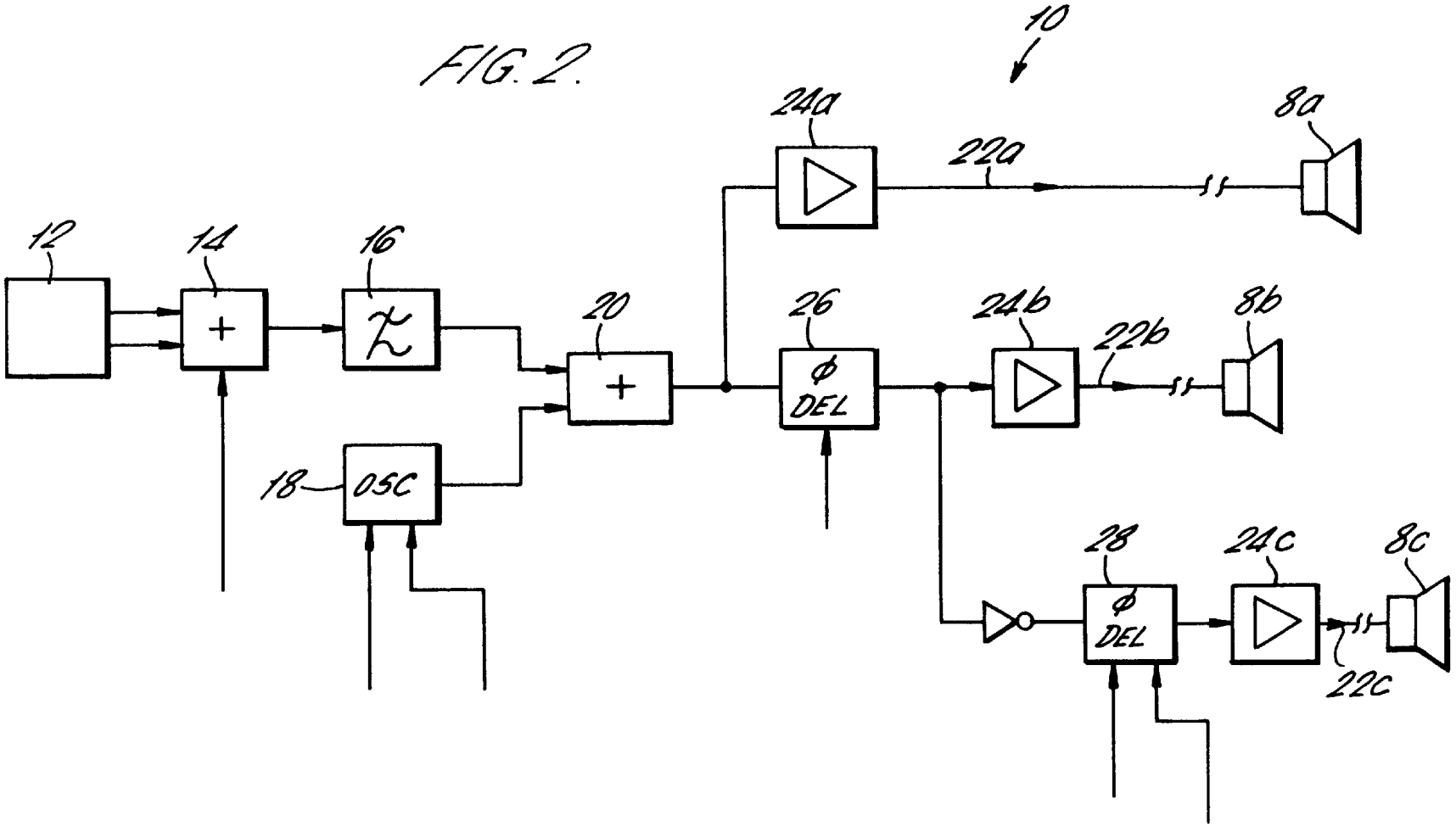
FIG. 2 shows a block diagram of the electrical circuit for use with the embodiment of FIG. 1.

FIG. 2 shows a block diagram of a circuit 10 for receiving an electrical oscillating signal and processing that oscillating signal to generate an input to the actuators 8*a*, 8*b*, 8*c* of FIG. 1. The circuit 10 includes a first input 12 for receiving an electrical audio signal which may be an electrical output from a sound system such as a compact disc player or other apparatus for generating sound. Typical audio frequencies are of the range of from 20 Hz to 20 KHz. The electrical audio signal is input to an adder which is used to combine the two parts of a stereo signal if the sound system is a stereo system. The combined signal from the adder 14 is processed by a low pass filter to remove frequencies above a predetermined frequency which would not be effective in causing movement of the mirror 4.

The circuit 10 also includes a second input 18 which is a frequency generator for providing a pure sinusoidal signal over a variable range. The processed audio signal and the frequency generator signal may be combined at a mixer 20 to generate an electrical oscillating signal for effecting movement of the actuators 8*a*, 8*b*, 8*c*. A first electrical oscillating signal 22*a* to the first actuator 8*a* is simply the output of the mixer 20 amplified by an amplifier 24*a*. A second signal 22*b* to the second actuator 8*b* is the output of the mixer 20 after amplification by an amplifier 24*b* and with a phase delay introduced by a first phase delay circuit 26. A third signal 22*c* to the third actuator 8*c* includes a further phase delay introduced by a second phase delay circuit 28 before amplification by an amplifier 24*c*.

The circuit 10 may include means to allow a user to control the following parameters:

At the adder 14—control of the gain or amplification of the audio signal.

At the frequency generator 18—control of the frequency of the generated signal and the amplitude of the generated signal.

At the phase delay circuit 26 and 28—control of the phase delay.

At the second phase delay circuit 28—control of the gain of the circuit and therefore the relative amplitudes of the second and third signals 22*b*, 22*c*.

By setting the phase delay circuits to generate phase delays of 120° and 240° respectively and the amplifier gains to be equal, the mirror 4 can be made to pivot about an imaginary point at its centre, causing light from a single point on the projected image to plot a circle on the screen 6. As the light signal from the light projector 2 is not simply a single beam but the projection of an image, a circle is plotted on the screen 6 for every point of the projected image. In this particular setting, pivoting of the mirror about a single imaginary point means that the focussing of the projected image onto the screen 6 is not affected.

Modulating means other than the circular planar glass mirror 4 of FIG. 1 are envisaged. In particular, it is envisaged that the modulating means may comprise other types of reflectors, lenses or prisms. Non-planar or flexible reflecting surfaces may also be used. However, with non-planar flexible reflecting surfaces, care must be taken to ensure that the deflection of the modulating means is sufficiently controlled to provide a reasonably clean modulated image.

FIGS. 3 and 4 are representations of photographs to show the effect of the light pattern modulator on a projected image derived from an image cassette. It will be appreciated that photographs are only able to record the image at one point in time over a small but finite period determined by the shutter speed of the camera. In reality, the projected image is constantly moving both due to any variations in the projected image and to changes in input of the electrical oscillating signal.

Figure 3A:
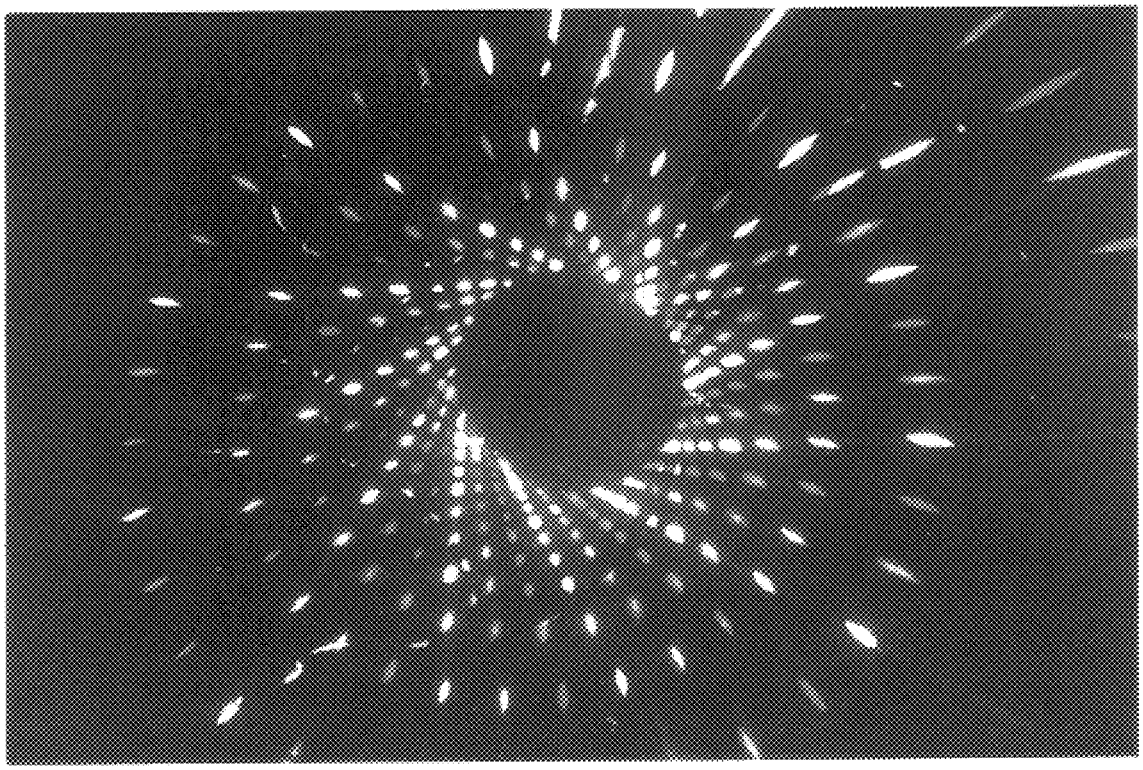
FIG. 3A shows one projected image and FIGS. 3B and 3C show the projected image of FIG. 3A modulated in accordance with an embodiment of the present invention.

FIG. 3A shows a projected image with no input to the actuators. The projected image comprises a plurality of small regions of light of different colours formed in a pattern. The pattern as shown in FIG. 3A may be caused to rotate due to the setting of the light projector 2. However, as already mentioned above, this rotation cannot be seen in the photograph of FIG. 3A.

Figure 3B:
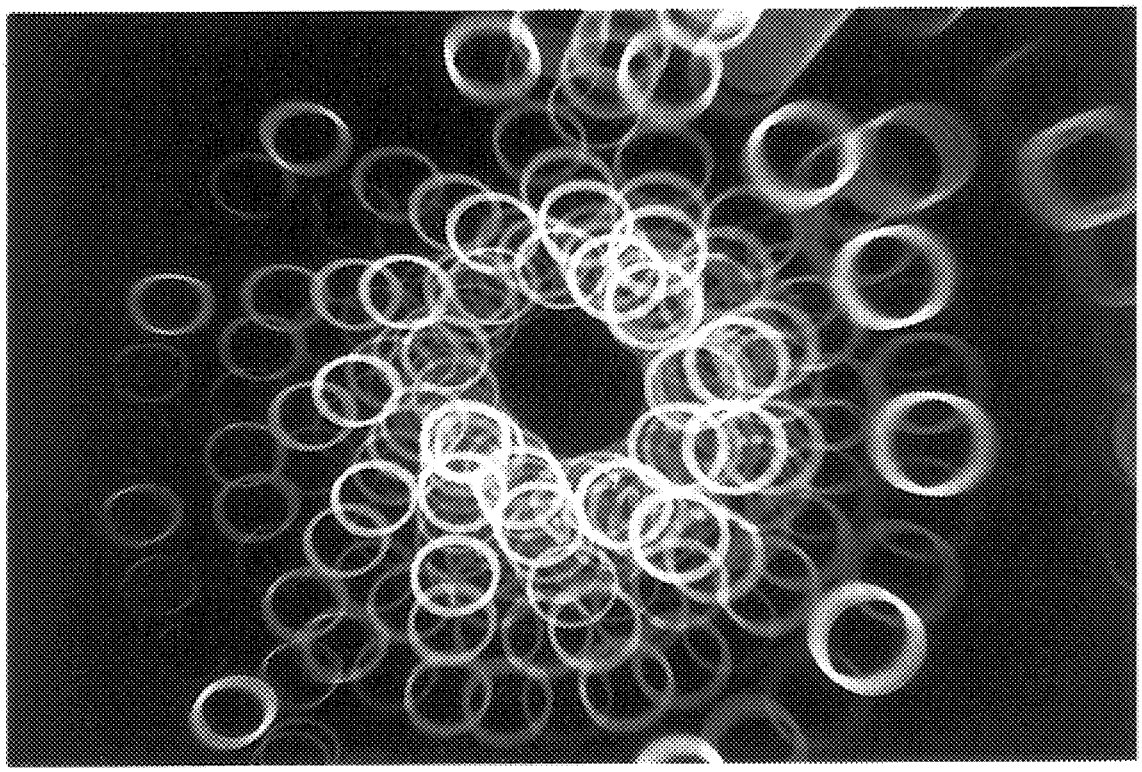

FIG. 3B shows the image on the screen 6 after modulation by the mirror 4 with the phase delays set at 120° and 240° respectively. Each small region of light in the pattern of FIG. 3A results in a three-dimensional ring which appears, fades and re-appears as the cassette rotates and the audio signal changes.

Figure 3C:
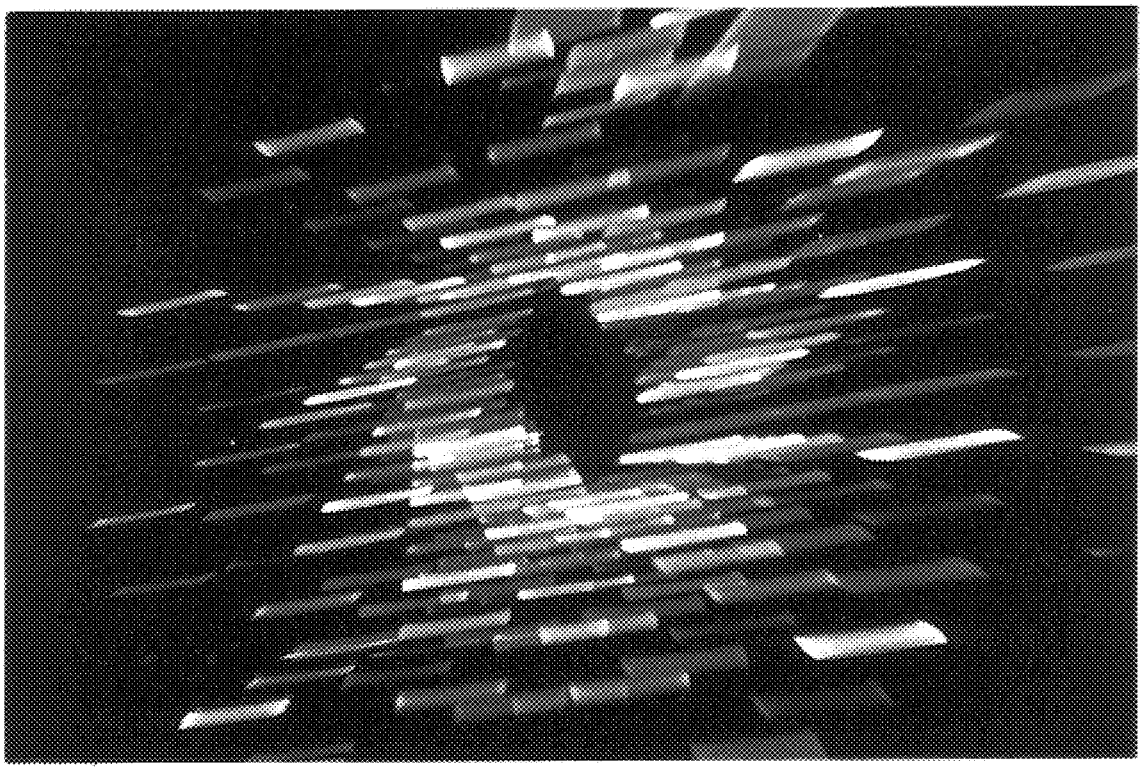

FIG. 3C shows the image on the screen 6 with one of the phase delays set to zero thus causing zero relative movement of two of the actuators. Each region of light in the pattern of FIG. 3A produces a calligraphy line in the image projected onto the screen 6.

Figure 4A:
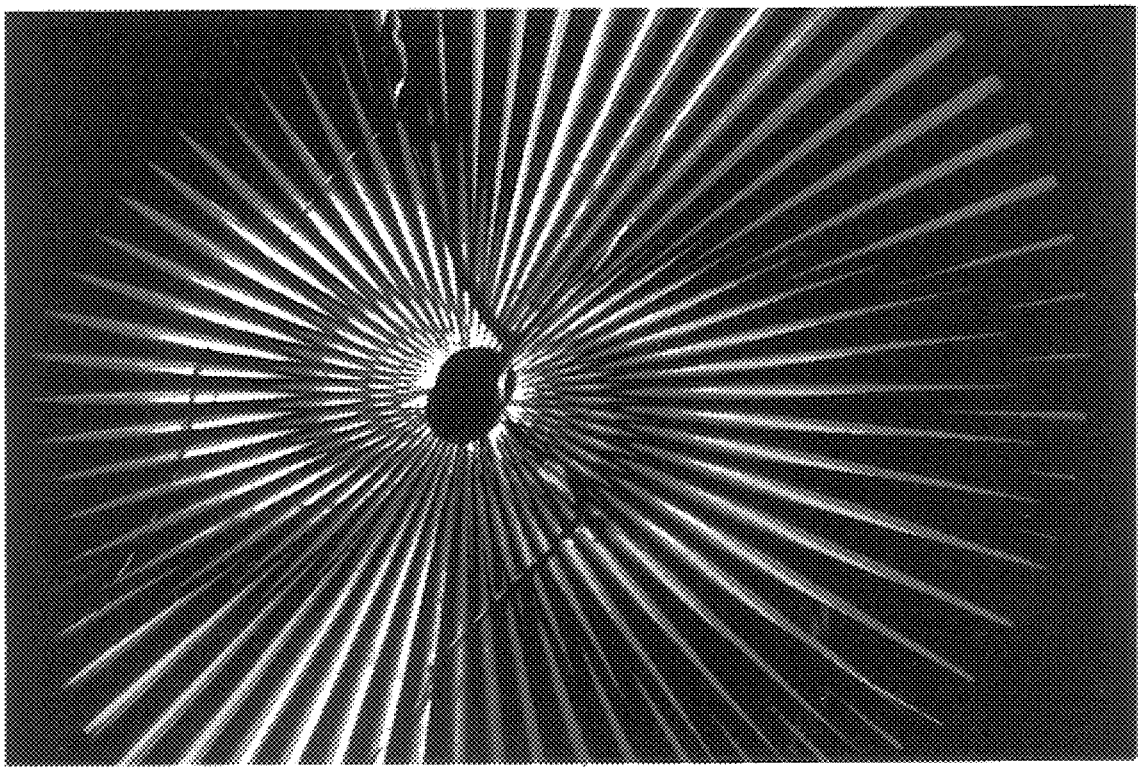
FIG. 4A shows another projected image and FIGS. 4B and 4C show the projected image of FIG. 4A modulated in accordance with an embodiment of the present invention.
Figure 4B:
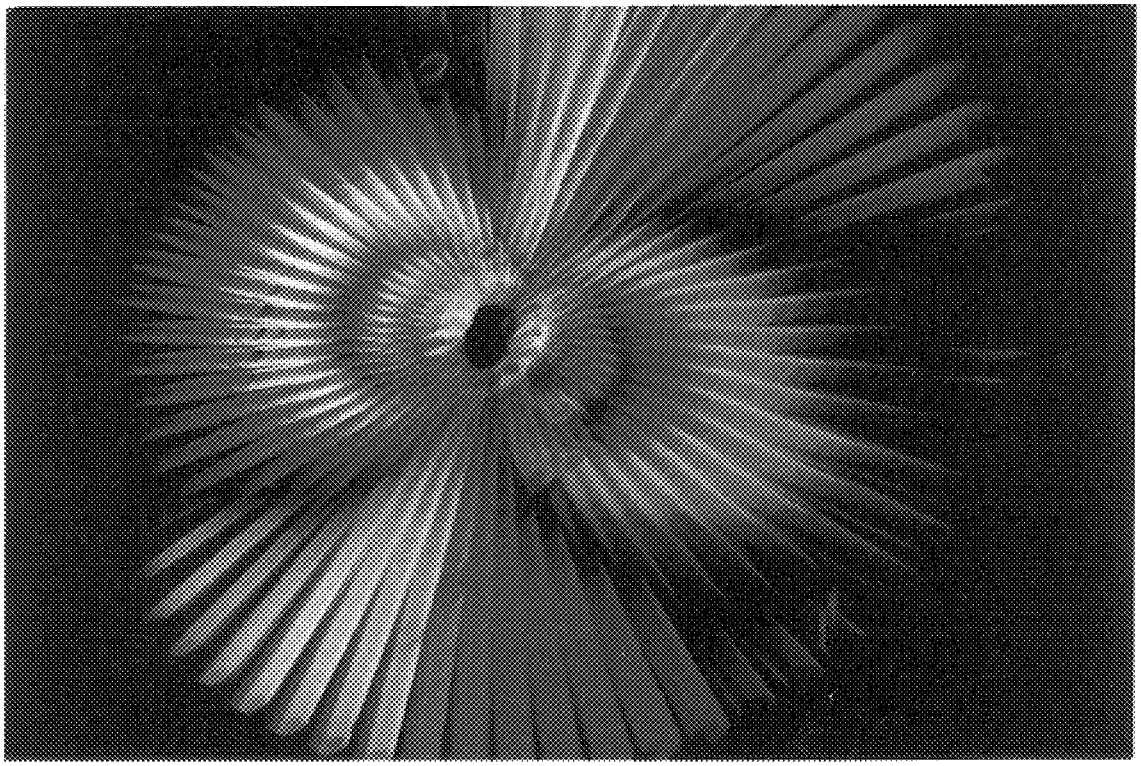
Figure 4C:
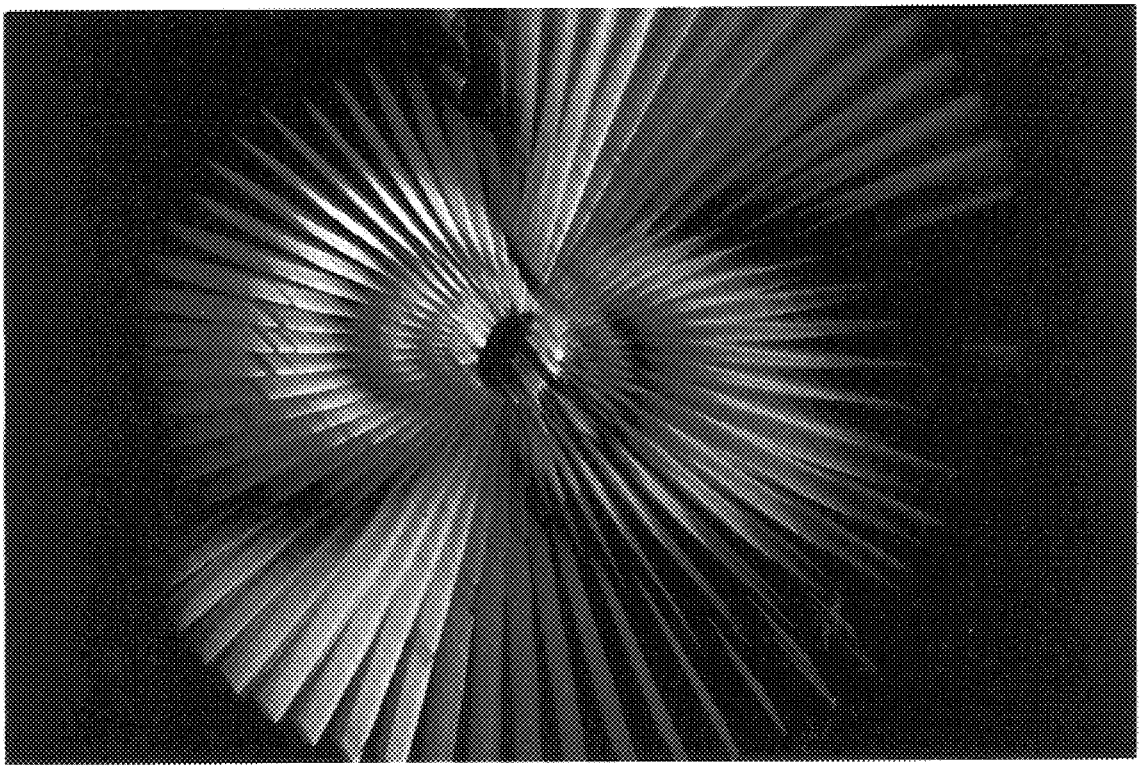

FIGS. 4A, 4B and 4C show a different image from the image cassette of the light projector 2 with phase delay settings corresponding to the phase delays of respectively FIGS. 3A, 3B and 3C. With zero audio input, the projected image from the light projector comprises a plurality of lines in the pattern shown in FIG. 4A. With the phase delay settings of 120° and 240°, the lines of FIG. 4A result in the tubes of FIG. 4B because each point on the line of the projected image results in a circle on the screen 6. With one of the phase delay circuits set to zero delay, each point on the line of the projected image of 4*a* results in a line in the image of 4*c* and so each line of FIG. 4A produces what appears to be a plane in FIG. 4C.

It will be appreciated that the combined effect of variation in the original projected image, movement of the modulating means and variation in the movement of the modulating means effected by the electrical oscillating signal input to the system results in a visually stunning effect particularly when combined with music generated by the same audio signal which is input to the circuit 10.

Existing light projector systems with non-laser light sources may use a filament lamp or an arc lamp. In an arc lamp, the light i8 generated by an electric arc between two electrodes which excites the gas surrounding the electrodes. An electric arc is generated with each cycle of the power supply to the arc lamp, typically 50 Hz when the arc lamp is powered by mains electricity. The lamp is therefore caused to pulse or strobe but-at such a rate that the human eye perceives the lamp to be constantly lit. When such an arc lamp is used to generate the projected image from the light projector, interesting effects may be caused by using an oscillating signal to the actuators having a frequency of around 50 Hz. The movement of the mirror at a frequency similar to the arcing of the arc lamp emphasises the arcing of the lamp in the modulated image projected on the screen. Each point of light in the projected image from the light projector results in a ring in the modulated image on the screen but each ring has two segments of lower intensity resulting from those periods when the arc lamp is about to strike. These areas of differing intensity in the rings can be used to generate an effect where the rings appear to rotate by slightly altering the frequency of the oscillating signal supplied to the actuators.

This effect adds a whole new dimension of movement and control to the image manipulation and can emphasize the "warping" effect (the interference patterns produced by two angled grids or gratings) on which a variety of lighting effects are based. The systems ability to stack or interconnect images also assists in emphasizing this effect as well as adding three-dimensionality to projections by creating differing moving layers whose colour creates the depth.

The light pattern modulator may be used in combination with a light projector having a fast rotating colour wheel. At zero audio excitation, the speed of the rotating colour wheel simply produces white light. Inputting an electrical oscillating signal to the actuators results in multicoloured rings, each coloured ring corresponding to a region of colour in the colour wheel. The coloured rings can further be caused to rotate by changing the frequency of the audio signal.

A variety of audio signals may be used to drive the actuators; for example, instead of using a single oscillating signal with phase delay circuitry, the circuit 10 may comprise a separate oscillating signal for each actuator. The same effect as provided by the delay circuitry may be achieved if a particular oscillating signal is sampled and a phase delay is introduced into the sampled signal before the sampled signal is input to the actuators. The electrical audio signal may be generated in real time from a sound system, either recorded music or from a live band. Alternatively, the electrical audio input to the circuit it may be a sampled signal used to create a particular visual effect without resulting in a corresponding sound.

The light pattern modulator of the present invention provides a high degree of versatility in achieving variations in the projected light image which vary with an electrical oscillating signal and, in particular, which vary with the music being generated.

What is claimed is:

1. Apparatus for generating light patterns from incident light in response to an electrical oscillating signal, the apparatus comprising:

an input for receiving an electrical oscillating signal;

at least two transducers for effecting linear displacement in response to the electrical oscillating signal;

a modulator for modulating light incident thereon, the modulator being mounted on said at least two transducers for enabling movement of the modulator effected by said at least two transducers not to be physically constrained to movement about a fixed point or axis.

2. A light pattern modulator according to claim 1 in which the modulator comprises a single modulator mounted on said at least two transducers for effecting linear displacement in response to the oscillating signal.

3. A light pattern modulator according to claim 1 in which the modulator comprises a reflector.

4. A light pattern modulator according to claim 3 in which the modulator comprises a mirror.

5. A light pattern modulator according to claim 4 in which the mirror is a planar mirror.

6. A light pattern modulator according to claim 1 in which the modulator comprises a refractor.

7. A light pattern modulator according to claim 1 in which said at least two transducers comprises three transducers.

8. A light pattern modulator according to claim 1 in which said at least two transducers comprises inductors positioned within a magnetic field.

9. A light pattern modulator according to claim 1 in which the input comprises phase delay apparatus for generating a phase delayed oscillating signal, the phase delay apparatus being coupled to at least one of the transducers.

10. A light pattern modulator according to claim 9, wherein the phase delay apparatus is effective for coupling an oscillating signal of a different phase to each transducer.

11. A light pattern modulator according to claim 9 further comprising an amplifier for amplifying the oscillating signal, the amplifier being coupled between the phase delay apparatus and the transducers.

12. A light pattern modulator according to claim 1 further comprising a frequency generator for generating an oscillating signal.

13. A light pattern modulator according to claim 1 further comprising a generator of an electrical audio signal.

14. Apparatus for generating light patterns in response to an electrical oscillating signal, the apparatus comprising:

an input for receiving an electrical oscillating signal;

at least two transducers for effecting linear displacement in response to the oscillating signal;

a modulator for modulating light incident thereon, the modulator being mounted on said at least two transducers for enabling movement of the modulator effected by said at least two transducers not to be physically constrained to movement about a fixed point or axis;

and a light projector for projecting an image onto the modulator.

15. Apparatus according to claim 14 in which the light projector comprises a non-laser light source.

16. Apparatus according to claim 14 in which the light projector comprises a filament lamp.

17. Apparatus according to claim 14 in which the light projector comprises an arc lamp.

18. Apparatus according to claim 14 in which the light projector comprises a projector which projects an image which varies with time.

19. Apparatus according to claim 18 in which the light projector comprises a projector which pulses the image.

20. Apparatus according to claim 14 in which the modulator comprises a single modulator mounted on said at least two transducers for effecting linear displacement in response to the oscillating signal.

21. Apparatus according to claim 14 in which the modulator comprises a reflector.

22. Apparatus according to claim 21 in which the modulator comprises a mirror.

23. Apparatus according to claim 22 in which the mirror is a planar mirror.

24. Apparatus according to claim 14 in which the modulator comprises a refractor.

25. Apparatus according to claim 14 in which said at least two transducers comprises three transducers.

26. Apparatus according to claim 14 in which said at least two transducers comprise inductors positioned within a magnetic field.

27. Apparatus according to claim 14 in which the input comprises phase delay apparatus for generating a phase delayed oscillating signal, the phase delay apparatus being coupled to at least one of the transducers.

28. Apparatus according to claim 27, wherein the phase delay apparatus is effective for coupling an oscillating signal of a different phase to each transducer.

29. Apparatus according to claim 27 further comprising an amplifier for amplifying the oscillating signal, the amplifier being coupled between the phase delay apparatus and the transducers.

30. Apparatus according to claim 14 further comprising a frequency generator for generating an oscillating signal.

31. Apparatus according to claim 14 further comprising a generator of an electrical audio signal.

32. A method of generating light patterns in response to an electrical oscillating signal, the method comprising the steps of:

providing at least two transducers and a modulator for modulating light incident thereon;

mounting the modulator on said at least two transducers so as to enable movement of said modulator effected by said at least two transducers not to be physically constrained to movement about a fixed point or axis;

projecting a light image onto said modulator;

receiving an electrical oscillating signal; and effecting linear displacement of said at least two transducers in response to the oscillating signal so as to produce a modulated light image.

33. A method according to claim 32 in which the step of projecting a light image uses a non-laser light source.

34. A method according to claim 33 in which the step of projecting a light image uses a filament lamp.

35. A method according to claim 33 in which the step of projecting a light image uses an arc lamp.

36. A method according to claim 32 in which the step of projecting a light image comprises the step of projecting a light image which varies with time.

37. A method according to claim 36 in which the step of projecting a light image comprises the step of pulsing the light image.

38. A method according to claim 32 in which the step of effecting linear displacement of said at least two transducers comprises:

oscillating said at least two traducers at a frequency and an amplitude determined by the electrical oscillating signal.

39. A method according to claim 32 in which the step of effecting linear displacement of said at least two transducers comprises the step of oscillating said at least two transducers at the same frequency and amplitude but different phases.

40. A method according to claim 32 in which the step of receiving the oscillating signal comprises the step of receiving a signal generated by a frequency generator.

41. A method according to claim 32 in which the step of receiving the oscillating signal comprises the step of receiving an electrical audio signal.

42. A method according to claim 41 in which the electrical audio signal is also input to a sound system for generating sound in response to the electrical audio signal.

43. A method according to claim 32 in which the step of projecting a light image onto said modulator comprises the step of projecting the light image onto a reflective modulator.

44. A method according to claim 32 in which the step of projecting a light image onto said modulator comprises the step of protecting the light image onto a refractive modulator.

* * * * *